US005655200A

United States Patent [19]

Oyama

[11] Patent Number: 5,655,200

[45] Date of Patent: Aug. 5, 1997

[54] IMAGE TRANSFERRING DEVICE FOR AN IMAGE FORMING APPARATUS AND METHOD OF FORMING SAME

[75] Inventor: Hajime Oyama, Ichikawa Chiba, Japan

[73] Assignee: Ricoh Company, Ltd., Tokyo, Japan

[21] Appl. No.: 564,823

[22] Filed: Nov. 29, 1995

[30] Foreign Application Priority Data

Nov. 29, 1994 [JP] Japan ..... 6-294352

[51] Int. Cl.[6] ..... G03G 15/16

[52] U.S. Cl. ..... 399/313; 399/312

[58] Field of Search ..... 355/271, 273, 355/274, 275; 399/312, 313

[56] References Cited

U.S. PATENT DOCUMENTS 5,172,173 12/1992 Goto et al. ..... 355/275

5,191,378 3/1993 Itaya et al. ..... 355/274

*Primary Examiner*—Joan H. Pendegrass

*Attorney, Agent, or Firm*—Oblon, Spivak, McClelland, Maier & Neustadt, P.C.

[57] ABSTRACT

An image transfer device and method for providing an image transfer device are provided in which a transfer belt is utilized for transferring an image from an image carrier to a transfer sheet, with a bias member supplying a bias voltage to the transfer belt. The bias member has a first layer and a second layer, with the first layer contacting an inner surface of the transfer belt, and with the second layer disposed below the first layer. The volume resistivity of the first layer is larger than that of the second layer. A relationship is also provided of an acceptable range of belt and roller resistivities, such that maintaining each of the belts and rollers (bias members) of a production lot within the range limits will ensure acceptable results despite variations of belt and roller resistivities within the production lot.

16 Claims, 5 Drawing Sheets

IMAGE TRANSFERRING DEVICE FOR AN IMAGE FORMING APPARATUS AND METHOD OF FORMING SAME

BACKGROUND OF THE INVENTION

1. Field of the Invention

The present invention relates to an image transferring device for an image forming apparatus such as a copier, printer, facsimile transceiver or similar photographic image forming apparatus in which an image is electrostatically formed on an image carrier. More particularly, the invention provides an image transferring device and a method for manufacturing an image transferring device in which an image is transferred from an image carrier to a transfer sheet while the transfer sheet is electrostatically adhered to and transported by a transfer belt.

2. Description of the Related Art

Japanese Patent Laid-Open Publication No. 6-3971 discloses a conventional image transferring device for an image forming apparatus, with the transfer device provided for an image forming apparatus such as a copier, or a printer. Referring to FIG. 4, with such an image forming apparatus, a transfer belt 2 is disposed below a photosensitive drum 1 and passes over a conductive drive roller 5 and a conductive driven roller 4. The conductive drive roller 5 is connected to a motor, not shown, and is rotated in a direction indicated by an arrow in the figure. As the conductive drive roller 5 is rotated, the transfer belt 2 is moved in a direction for transferring a transfer sheet (indicated by the arrow in the figure).

A bias roller 3 is located downstream of the conductive driven roller 4 with respect to the moving direction of the transfer belt 2. The bias roller 3 is held in contact with an inner surface of the transfer belt 2. In addition, a ground plate 6 is located upstream of the conductive driven roller 4 with respect to the moving direction of the transfer belt 2, and is connected to ground so as to allow a flow of electric current from the transfer belt 2 to ground. A power source 7 is connected to the bias roller 3, and applies a charge/current to the transfer belt 2 which is opposite in polarity to that of the toner deposited on the photosensitive drum 1. A resistor 9 is provided between the ground plate 6 and ground. A current control unit 10 is provided so as to control the output of the power source 7. The electric current is fed to the transfer belt 2 via the bias roller 3 from the power source 7. In addition, an eraser (not shown) is disposed near the conductive driven roller 4 so as to remove the charge from the transfer belt 2 by irradiation.

In operation, the transfer sheet is delivered from a paper feeding device, not shown. The transfer sheet is polarized/charged by the charge applied from the bias roller 3 via the transfer belt 2. The transfer sheet is thus adhered onto the transfer belt 2 by the electrostatic charge. A toner image is transferred from the photosensitive drum 1 to the transfer sheet and the transfer sheet on which the toner image is formed is delivered by the transfer belt 2. The transfer sheet is then separated from the transfer belt 2 at the location of the conductive drive roller 5 by the rigidity of the transfer sheet. This separation is also known as a curvature separation (i.e., the sheet separates as it passes over the curvature of the roller).

Japanese Patent Laid-Open Publication No. 6-3972 discloses another conventional image transferring device for an image forming apparatus, with the transfer belt device provided for an image forming apparatus such as a copier, or a printer. As shown in FIG. 5, this arrangement includes a current control unit 11, provided to control the output of the power source 7. The remaining elements are designated with reference numerals as discussed with reference to FIG. 4, and therefore a description of these elements is omitted.

With such a current control unit, the current flowing from the transfer belt to the drum can be maintained constant. For example, assume that an output current flowing from the power source to the transfer belt 2 via the bias roller 3 is I-1, and that a feedback current flowing from the transfer belt 2 to the current control unit 11 via the ground plate 6 is I-2. The output current from the power source is controlled so as to satisfy a following equation:

$$I\text{-}1-I\text{-}2=K$$

where K is constant.

With this relationship, current flowing from the transfer belt 2 to the photosensitive drum 1 remains constant and the toner image can more reliably be transferred to the transfer sheet under a stable transfer condition.

However, in the foregoing arrangements, the transfer belt 2 is repeatedly bent, and also expands after long periods of use. As a result, the structural state of the transfer belt 2 becomes unstable. For example, a coated portion on an outer surface of the transfer belt 2 can partially peel off, or a crack can occur on the outer surface of the transfer belt 2 due to deterioration over time. With such deterioration, a portion (e.g., the peeled-off or cracked portion) has a low-resistance value as compared with surrounding peripheral portions. In this condition, with the surface of the transfer belt 2 in pressure contact with the photosensitive drum 1, a large current flows at the deteriorated portion of the transfer belt 2, and abnormal leakage occurs between the transfer belt 2 and the photosensitive drum 1. Such abnormal current leakage can cause pin-hole damage to the photosensitive drum 1, and/or blanking of an image (i.e., a portion of an image is not formed) due to damage of the drum. Further, deterioration or damage to the belt or drum can cause the transfer rate to decrease.

SUMMARY OF THE INVENTION

It is an object of the invention to overcome the foregoing shortcomings.

Accordingly, one object of the invention is to provide an image transferring device in which abnormal current leakage is suppressed so as to prevent pin-hole (or other) damage to the photosensitive drum.

It is another object of the present invention to provide an image transferring device for an image forming apparatus which can reduce the maintenance and production cost of a transfer belt for an image forming apparatus.

In order to achieve the above-mentioned objects, according to the present invention, an image transferring device is provided for an image forming apparatus in which a transfer belt is utilized for transferring an image from an image carrier to a transfer sheet, with a bias member supplying a bias voltage/current to the transfer belt. In accordance with a presently preferred form of the invention, the bias member includes first and second layers, with the first layer contacting an inner surface of the transfer belt, and with the first layer (which is disposed on the second layer) having a volume resistivity larger than that of the second layer. Preferably, the first layer of the bias member has a volume resistivity of $10^5$ Ωcm to $10^9$ Ωcm, while the volume resistivity of the belt surface which contacts the bias member is from $10^5$ Ωcm to $10^{10}$ Ωcm.

In accordance with a further aspect of the present invention, a method for forming an image transfer device is provided. In accordance with this aspect of the invention, an advantageous relationship between the volume resistivity of the transfer belt and that of the bias roller is provided. In addition, a range of acceptable resistivity values are provided for each of the transfer belt and bias roller, such that despite differences in resistivity resulting from, e.g., manufacturing variation, the bias member and transfer belt nevertheless provide satisfactory performance.

BRIEF DESCRIPTION OF THE DRAWINGS

The above and other objects, features and advantages of the present invention will become apparent from the following detailed description, particularly when considered in conjunction with the accompanying drawings in which.

DESCRIPTION OF THE PREFERRED EMBODIMENTS

Preferred embodiments of an image transferring device for an image forming apparatus in accordance with the present invention will now be explained with reference to the accompanying drawings, wherein like numerals are utilized to designate identical or corresponding elements throughout the several views.

Figure 1:
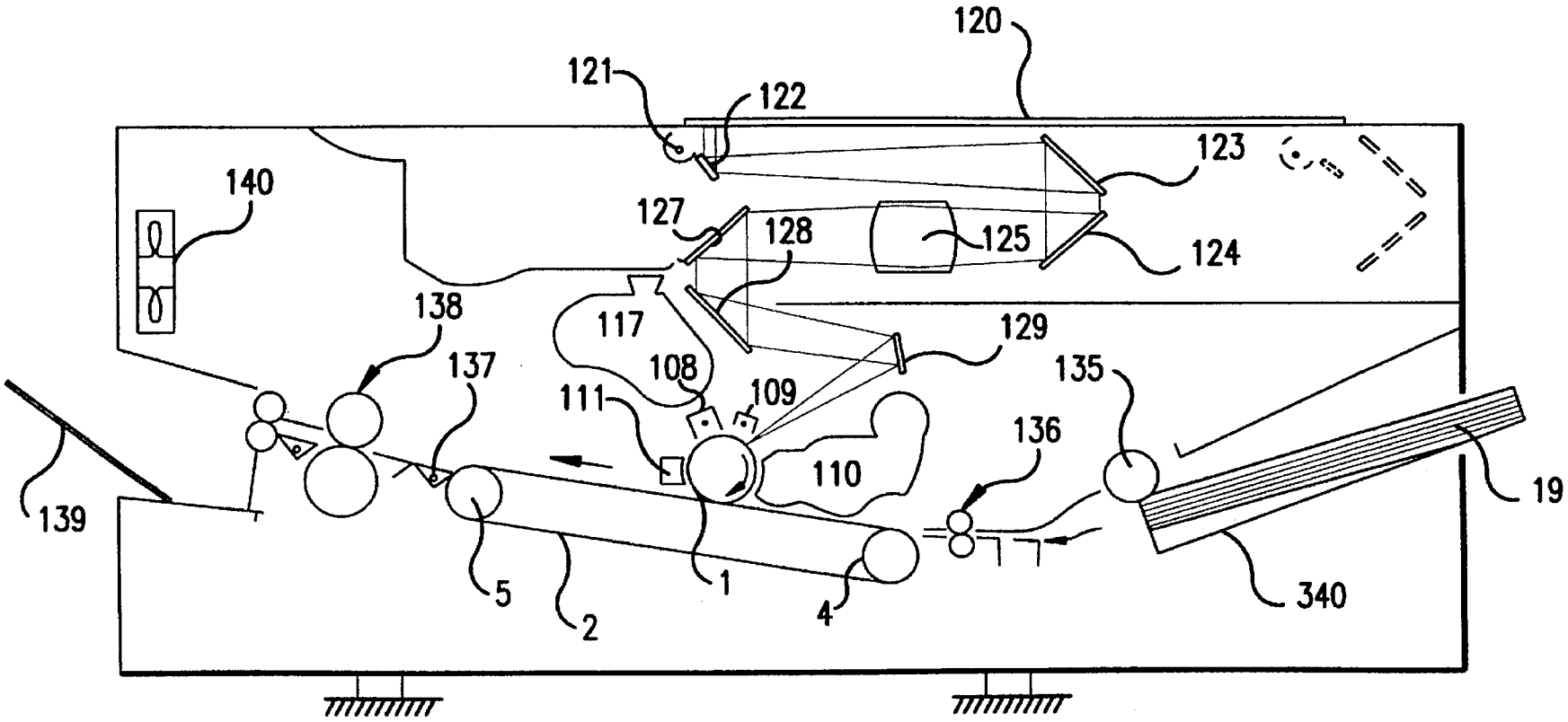
FIG. 1 is a schematic sectional view of an embodiment of a copier in accordance with the present invention.

FIG. 1 is a schematic side sectional view of an embodiment of a copier to which the present invention is applicable. Referring to FIG. 1, the copier includes a photosensitive drum 1 which is rotatably supported by a housing of the copier. The photosensitive drum 1 is driven to rotate in the direction indicated by an arrow at a constant speed.

An endless transfer belt 2 extends around a conductive drive roller 5 and a conductive driven roller 4. The transfer belt 2 is driven to travel in the direction indicated by an arrow, with an outer surface of the transfer belt 2 in rolling contact with the photosensitive drum 1. Around the photosensitive drum 1, and with respect to the direction of rotation thereof, are disposed a primary charger 108, a secondary charger 109, a developing unit 110 for developing a latent image with toner, the transfer belt 2, and a cleaning unit 111. In addition, an image exposure position for applying a light image from an original to the photosensitive drum 1 is defined between the secondary charger 109 and the developing unit 110.

The image forming apparatus shown in FIG. 1 also includes a contact glass 120 which serves as an original holder, at which an original to be copied is located. Below the contact glass 120, an illumination lamp 121 is provided for illuminating an original placed on the contact glass 120. Reflecting mirror 122 is integrally provided with the illuminating lamp 121. Another pair of reflecting mirrors 123 and 124 are also provided below the contact glass 120 to change the direction of the light image reflected from the reflecting mirror 122. The illumination lamp 121 and the reflecting mirrors 122, 123 and 124 move along the contact glass 120 to perform a slit scanning operation for the original placed on the contact glass 120. A focusing lens 125 is also provided for receiving light reflecting from the reflecting mirror 124. Thus, an optical path is provided for forming a latent image on the photoconductive drum, with the optical path indicated by the broken line.

Still referring to FIG. 1, the sheet feeding and image transfer will now be described. As shown in FIG. 1, a stack of transfer sheets 19 is placed on a supply table 340. A feed roller 135 is provided at the supply end of the supply table 340 in contact with the topmost transfer sheet 19 of the stack. When the feed roller 135 is intermittently driven to rotate in synchronism with the progress of a copying operation, the transfer sheets 19 are supplied one by one and then transported by transport rollers 136 onto the transfer belt 2. The transfer sheet 19 then contacts the photosensitive drum 1, such that a toner image is transferred from the photosensitive drum 1 to the transfer sheet 19.

A separating pawl 137 is disposed at the end of the forward travel of the transfer belt 2, to separate the transfer sheet 19 from the transfer belt 2. The transfer sheet 19 then proceeds toward an image fixing unit 138 where the toner image is fixed upon the transfer sheet 19. The transfer sheet 19 is then discharged onto a tray 139. A ventilation fan 140 is also provided for ventilating the air inside the copier.

A preferred embodiment of the present invention will now be described by way of example, as other embodiments are possible. Different embodiments may perform better under different conditions, for example, based upon the selection of different materials for the various elements. In addition, the selection of a predetermined spacing among the respective elements may vary based upon, e.g., the overall size of the apparatus and the composition of the various elements.

Figure 2:
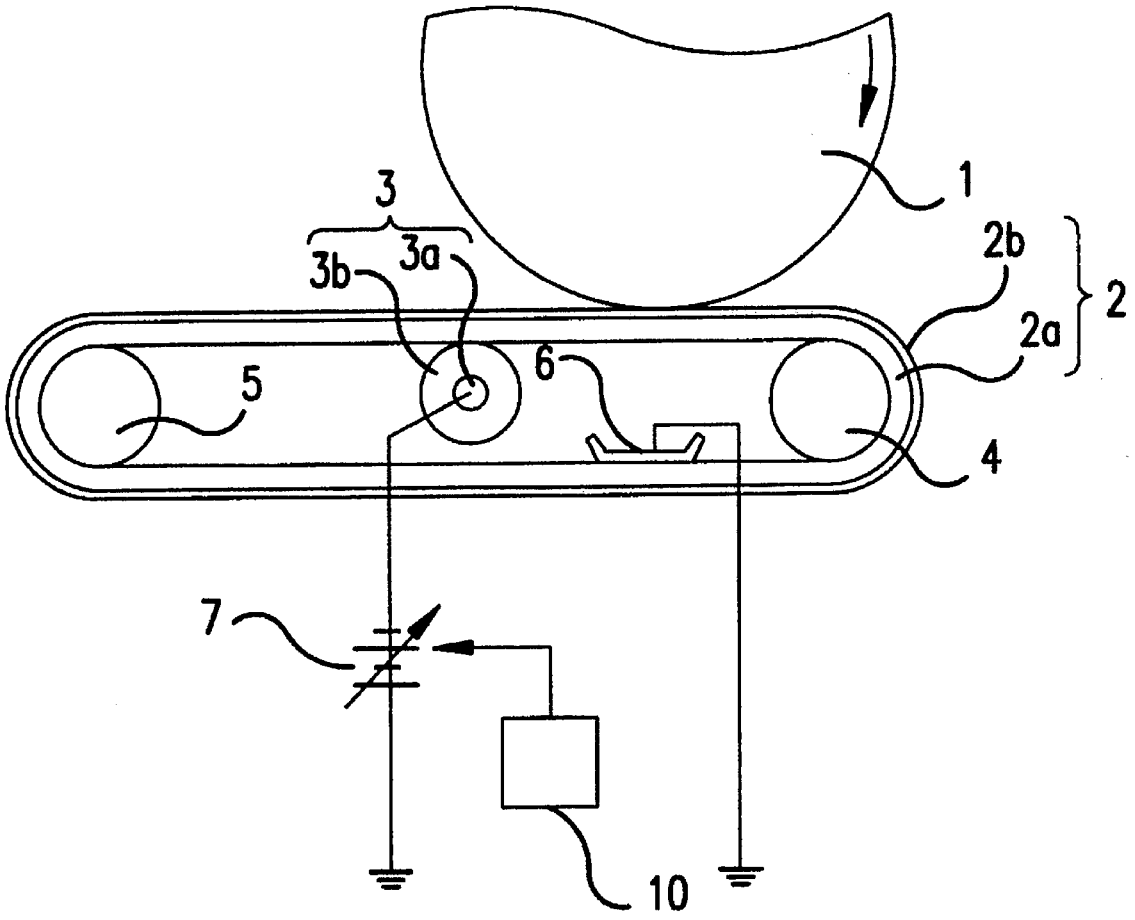
FIG. 2 is a side view showing the construction of an embodiment of an image transferring device for an image forming apparatus in accordance with the present invention.

FIG. 2 is a side section illustrating the construction of an embodiment of an image transferring device for an image forming apparatus in accordance with the present invention, which can be used, for example, in a copier or printer. The image transferring device has a transfer belt 2, a drive roller 5, a conductive driven roller 4, a bias roller 3, a ground plate 6, a power source 7, and a current control unit 10. The transfer belt 2 has an inner surface 2*a* and an outer surface 2*b*.

In a presently preferred form of the invention, the volume resistivity $\rho_{b-1}$ of the inner surface 2*a* is in the range of $10^5$ Ωcm to $10^{10}$ Ωcm, while the volume resistivity $\rho_{b-o}$ of the outer surface 2*b* is in the range of $10^{10}$ Ωcm to $10^{14}$ Ωcm. In addition, the thickness $t_{b-1}$ of the inner surface 2*a* is 0.1 to 1.0 mm, while the thickness $t_{b-o}$ of the outer surface b is 1.0 to 10.0 μm. Further, the values for $\rho_{b-1}$, $\rho_{b-o}$, $t_{b-1}$, and $t_{b-o}$ preferably satisfy the following conditions so as to suppress abnormal current leakage:

$$\rho_{b-o}>\rho_{b-1};$$

$$t_{b-o}<t_{b-1};$$

and $$\rho_{b-o}\cdot t_{b-o}\geqq\rho_{b-1}\cdot t_{b-1}.$$

The bias roller 3 has a metallic core 3*a* and a surface layer 3*b* covering the metallic core 3*a*. The volume resistivity $\rho_{r-c}$ of the metallic core 3*a* is in the range of $10^0$ Ωcm to $10^1$ Ωcm, while the volume resistivity $\rho_{r-s}$ of the surface layer 3b is in the range of $10^6$ Ωcm to $10^9$ Ωcm. In addition, the diameter $d_{r-c}$ of the metallic core 3a is from 6 to 20 mm, whereas the thickness $t_{r-s}$ of the surface layer 3b is 1.0 to 10 μm.

Preferably, $\rho_{r-c}$, $\rho_{r-s}$, $t_{r-s}$, $\rho_{b-1}$, and $t_{b-1}$ satisfy the following conditions so as to suppress abnormal current leakage:

$$\rho_{r-c}<\rho_{r-s};$$

and $$\rho_{r-s}\cdot t_{r-s}\leqq\rho_{b-1}\cdot t_{b-a}.$$

When the volume resistivity $\rho_{b-1}$ of the inner surface 2a in the transfer belt 2 is $10^5$ Ωcm to $10^{10}$ Ωcm, and the volume resistivity $\rho_{r-s}$ of the surface layer 3b in the bias roller 3 is $10^6$ Ωcm–$10^9$ Ωcm, the image transferring device effectively provides a desired bias to the transfer belt, and problems associated with excessive leakage of current/charges to the image carrier can be avoided. Moreover, a volume resistivity $\rho_{b-1}$ of the inner surface 2a in the transfer belt 2 is $10^7$ Ωcm–$10^{10}$ Ωcm, and volume resistivity $\rho_{r-s}$ of the surface layer 3b in the bias roller 3 is $10^7$ Ωcm–$10^8$ Ωcm is particularly preferred.

With the foregoing arrangement and features of the bias roller and transfer belt, abnormal current leakage is avoided, such that damage to the image carrier or photosensitive drum can be avoided. In accordance with a further aspect of the present invention, it has been recognized that by providing a range of acceptable resistivities, manufacturing tolerances can be delimited so that despite variations among rollers and belts within a production lot, satisfactory performance for each belt and roller pair is ensured where the resistivities of the belt and rollers are maintained within acceptable tolerance ranges.

FIGS. 3A–3D provides charts of acceptable and unacceptable relationships between the resistance values of the transfer belt 2 (inner surface 2a) and that of the bias roller 3 (surface layer 3b). Referring to FIGS. 3A–3D, the range of volume resistivity $\rho_{r-s}$ values of the surface layer 3b of bias roller 3 has an upper value $\rho_{r-s\ max}$ and a lower value $\rho_{r-s\ min}$. In addition, the range of volume resistivity $\rho_{b-1}$ values of the inner surface 2a of the transfer belt 2 has an upper value $\rho_{b-1\ max}$ and lower value $\rho_{b-1\ min}$. In accordance with the present invention, it has been recognized that by providing values for $\rho_{b-1}$, $\rho_{r-s\ max}$, $\rho_{r-s\ min}$, $\rho_{b-1\ max}$, and $\rho_{b-1\ min}$ which satisfy the conditions set forth hereinafter, reasonably large tolerances in the production process are allowable, and the production cost of the transfer apparatus and transfer belt can thereby be reduced. Preferably, unevenness (variation) of the resistance value in the bias roller 3 should be maintained smaller than that of the transfer belt 2.

In accordance with an advantageous aspect of the present invention, it has been recognized that by maintaining the following tolerance relationships with respect to the resistivity of the belt and the resistivity of a roller or bias member, the power source 7 is more effectively utilized. Thus, a sufficient bias voltage can be provided to the transfer belt 2 via the bias roller 3 without overloading the power source 7. In addition, abnormal leakage is prevented, thus preventing damage to the image carrier as discussed earlier. More particularly, in accordance with the present invention, it has been recognized that relatively large tolerance ranges are possible (thus allowing for less expensive manufacturing), while ensuring satisfactory belt/bias member performance, where the maximum and minimum resistivity values within a production lot of belts and bias members satisfy the following relationships:

$$10^5\ \Omega cm<\rho_{b-1}<10^{10}\ \Omega cm$$

$$\log(\rho_{r-s\ max}/\rho_{r-s\ min})<\log(\rho_{b-1\ max}/\rho_{b-1\ min})$$

Figure 3A:
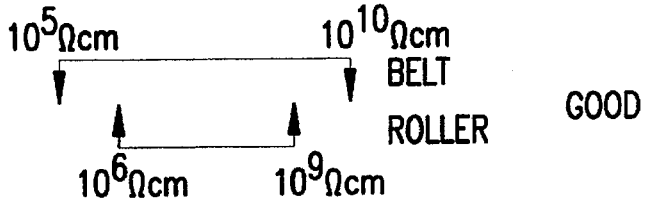
FIGS. 3A–3D are charts of relationships between the resistance values of a transfer belt and that of a bias roller.
Figure 3B:
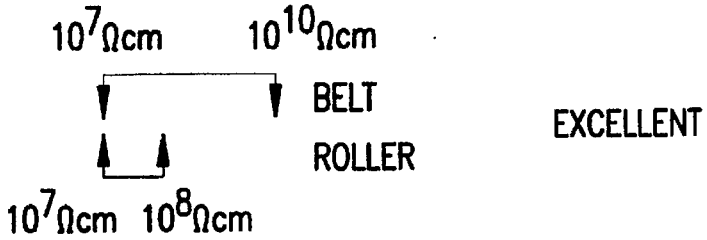
Figure 3C:
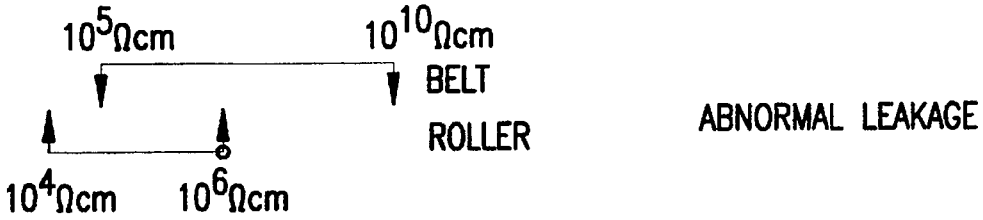
Figure 3D:
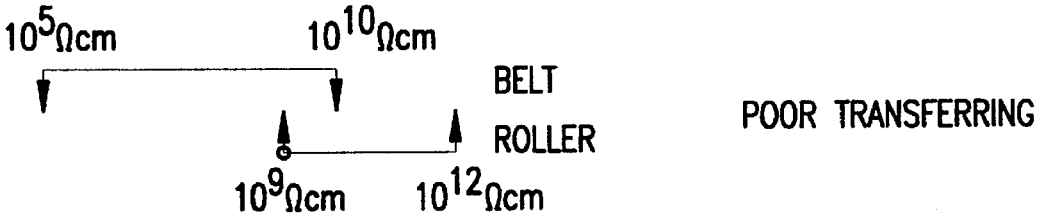
Figure 4:
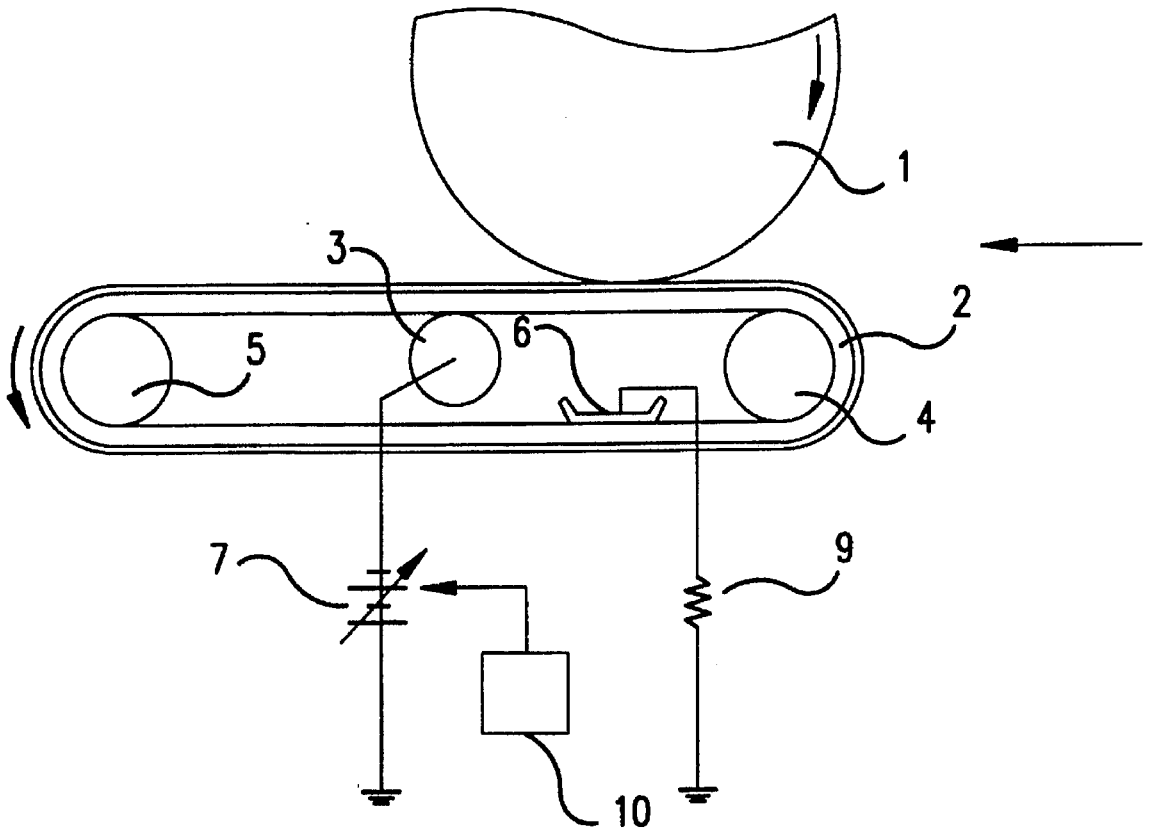
FIG.4 PRIOR ART
FIG. 4 is a side view showing the construction of a conventional image transferring device for an image forming apparatus.
Figure 5:
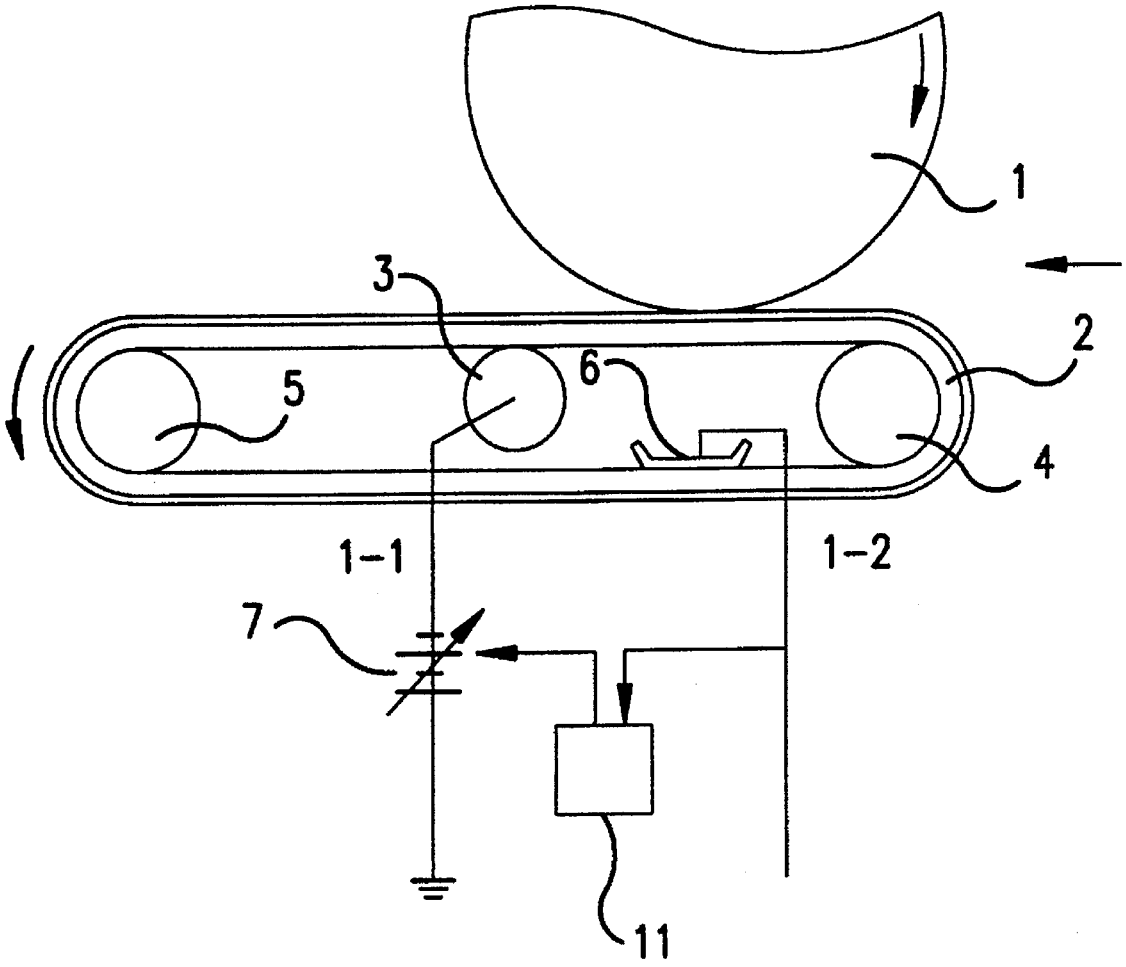
FIG.5 PRIOR ART
FIG. 5 is a side view showing the construction of another conventional image transferring device for an image forming apparatus.

As shown in FIGS. 3A–3D, by selecting $\rho_{r-s\ min}$, $\rho_{r-s\ max}$, $\rho_{b-a\ min}$ and $\rho_{b-1\ max}$ as a range of acceptable values within a production lot, acceptable results are achieved for each belt and roller pair selected from the production lot which satisfies the logrythmic discussed earlier. For example, as shown in FIG. 3A, acceptable results are achieved, and abnormal charge/current leakage is avoided where $\rho_{b-1\ min}$ and $\rho_{b-1\ max}$ are in the range of $10^5$ Ωcm to $10^{10}$ Ωcm, and $\rho_{r-s\ min}$ and $\rho_{r-s\ max}$ are in the range of $10^6$ Ωcm to $10^9$ Ωcm. Further, as indicated in FIG. 3B, particularly preferred results are achieved where $\rho_{b-1\ min}$ and $\rho_{b-1\ max}$ are in the range of $10^7$ Ωcm to $10^{10}$ Ωcm, and $\rho_{r-s\ min}$ and $\rho_{r-s\ max}$ are in the range of $10^7$ Ωcm to $10^8$ Ωcm. By contrast, when the volume resistivity $\rho_{b-1}$ of the inner surface 2a in the transfer belt 2 is $10^5$ Ωcm–$10^{10}$ Ωcm, and the volume resistivity $\rho_{r-s}$ of the surface layer 3b in the bias roller 3 is at least $10^4$ Ωcm, but less than $10^6$ Ωcm, abnormal leakage can occur as indicated in FIG. 3C (The circles in FIGS. 3A–3D denote that the end point value is excluded). Further, when the volume resistivity $\rho_{b-1}$ of the inner surface 2a in the transfer belt 2 is $10^5$ Ωcm–$10^{10}$ Ωcm, and the volume resistivity $\rho_{r-s}$ of the surface layer 3b in the bias roller 3 is greater than $10^9$ Ωcm and up to $10^{12}$ Ωcm, a poor transfer of images can result.

Thus, by maintaining belt and roller resistivities within the preferred resistivity ranges of the present invention, satisfactory belt and roller performance is ensured despite variations within a production lot.

In addition, in accordance with an additional advantageous aspect of the present invention, a rubber layer can be disposed to cover the surface layer 3b in the bias roller 3 so that the bias roller 3 contacts the transfer belt 2 directly opposite to the photosensitive drum, while problems associated with abnormal or excessive leakage can be avoided. As a result, greater compactness of the image transferring device can be achieved.

As should be apparent, various modifications are possible for those skilled in the art in view of the teachings of the present disclosure. It is therefore to be understood that within the scope of the present claims, the invention may be practiced otherwise than as specifically described herein.

What is claimed as new and desired to be secured by Letters Patent of the United States is:

1. A device for transferring an image from an image carrier to a transfer sheet in an image forming apparatus, comprising:

a drive roller;

a driven roller;

a transfer belt for transferring a toner image formed on an image carrier to a transfer sheet, said transfer belt passing over said drive roller and said driven roller;

a bias member;

a feedback member; and a power source for applying a voltage to said bias member, and including means for controlling an output of said power source, said power source being connected to said bias member;

wherein said bias member has a first layer and a second layer, said first layer is held in contact with an inner surface of said transfer belt and is disposed on said second layer, and wherein a volume resistivity of said first layer is larger than a volume resistivity of said second layer;

wherein said transfer belt includes a first layer and a second layer, and wherein said first layer of said transfer belt contacts said first layer of said bias member, and further wherein a volume resistivity of said first layer of said transfer belt is less than a volume resistivity of said second layer of said transfer belt; and wherein said first layer of said bias member has a thickness of 1.0 to 10.0 μm.

2. A device as recited in claim 1, wherein said first layer of said bias member is made of a rubber material.

3. A device as recited in claim 1 wherein said first layer of said transfer belt has a volume resistivity of $10^5$ Ωcm to $10^{10}$ Ωcm and said second layer of said transfer belt has a volume resistivity of $10^{10}$ to $10^{14}$ Ωcm.

4. A device as recited in claim 1, wherein said first layer of said bias member has a volume resistivity of $10^6$ Ωcm to $10^9$ Ωcm.

5. A device for transferring an image from an image carrier to a transfer sheet in an image forming apparatus, comprising:

a drive roller;

a driven roller;

a transfer belt for transferring a toner image formed on an image carrier to a transfer sheet, said transfer belt passing over said drive roller and said driven roller;

a bias member;

a feedback member; and a power source for applying a voltage to said bias member, and including means for controlling an output of said power source, said power source being connected to said bias member;

wherein said bias member has a first layer and a second layer, said first layer is held in contact with an inner surface of said transfer belt and is disposed on said second layer, and wherein a volume resistivity of said first layer is larger than a volume resistivity of said second layer;

wherein said transfer belt includes a first layer and a second layer, and wherein said first layer of said transfer belt contacts said first layer of said bias member, and further wherein a volume resistivity of said first layer of said transfer belt is less than a volume resistivity of said second layer of said transfer belt;

wherein said first layer of said transfer belt has a volume resistivity of $10^5$ Ωcm to $10^{10}$ Ωcm and said second layer of said transfer belt has a volume resistivity of $10^{10}$ Ωcm to $10^{14}$ Ωcm; and wherein said first layer of said transfer belt has a thickness of 0.1 to 1.0 mm, and said second layer of said transfer belt has a thickness of 1.0 to 10.0 μm.

6. A device as recited in claim 5, wherein said first layer of said bias member has a thickness of 1.0 to 10 μm.

7. A device as recited in claim 6, wherein said bias member comprises a roller and wherein said second layer of said bias member comprises a metallic core of said roller, said metallic core having a diameter of 6 to 20 mm.

8. A device as recited in claim 7, wherein said first layer of said bias member has a volume resistivity of $10^6$ Ωcm to $10^9$ Ωcm.

9. A device as recited in claim 6, wherein said first layer of said bias member has a volume resistivity of $10^6$ Ωcm to $10^9$ Ωcm.

10. A method for forming an image transferring device for an image forming apparatus comprising:

providing a first roller;

providing a second roller;

disposing a transfer belt about said first roller and said second roller;

providing a bias member having first and second layers, with said first layer having a volume resistivity larger than a volume resistivity of said second layer, and wherein said first layer is disposed over said second layer;

placing said bias member in contact with an inner surface of said transfer belt with said first layer of said bias member contacting said inner surface; and connecting a power supply to said bias member;

the method further including providing a plurality of said bias members, with the first layer of each of said plurality of bias members having a volume resistivity $\rho_{r-s}$ in a range of $\rho_{r-s\ min}$ to $\rho_{r-s\ max}$, providing a plurality of said transfer belts in which an inner surface of each of said transfer belts has a volume resistivity $\rho_{b-1}$ in a range of $\rho_{b-1\ min}$ to $\rho_{b-1\ max}$, and wherein:

$$\log(\rho_{r-s\ max}/\rho_{r-s\ min}) < \log(\rho_{b-1\ max}/\rho_{b-1\ min});$$

and forming a plurality of image transferring devices, each image transferring device formed by selecting one transfer belt from said plurality of transfer belts and one bias member from said plurality of bias members.

11. A method as recited in claim 10, further including providing as the first layer of each of the plurality of bias members a layer having a volume resistivity of $10^6$ Ωcm to $10^9$ Ωcm, and providing as the second layer of each of the plurality of bias members a layer having a volume resistivity of $10^0$ Ωcm to $10^1$ Ωcm.

12. A method as recited in claim 11, further including providing as each of the plurality of transfer belts a belt having first and second layers, and wherein said first layer of the transfer belt has a volume resistivity of $10^5$ Ωcm to $10^{10}$ Ωcm, and the second layer of the transfer belt has a volume resistivity of $10^{10}$ Ωcm to $10^{14}$ Ωcm.

13. A method as recited in claim 10, wherein each of said plurality of transfer belts has an inner surface volume resistivity of $10^5$ Ωcm to $10^{10}$ Ωcm.

14. A method as recited in claim 13, wherein the first layer of each of said plurality of bias members has a volume resistivity of $10^6$ Ωcm to $10^9$ Ωcm.

15. A method as recited in claim 10, wherein each of said plurality of transfer belts has an inner surface volume resistivity of $10^7$ Ωcm to $10^{10}$ Ωcm, and each of said plurality of bias members has a volume resistivity of said first layer of $10^7$ Ωcm to $10^8$ Ωcm.

16. A device for transferring an image from an image carrier to a transfer sheet in an image forming apparatus, comprising:

a drive roller;

a driven roller;

a transfer belt for transferring a toner image formed on an image carrier to a transfer sheet, said transfer belt passing over said drive roller and said driven roller;

a bias member;

a feedback member; and a power source for applying a voltage to said bias member, and including means for controlling an output of said power source, said power source being connected to said bias member;

wherein said bias member has a first layer and a second layer, said first layer is held in contact with an inner surface of said transfer belt and is disposed on said second layer, and wherein a volume resistivity of said first layer is larger than a volume resistivity of said second layer;

wherein said transfer belt includes a first layer and a second layer, and wherein said first layer of said transfer belt contacts said first layer of said bias member, and further wherein a volume resistivity of said first layer of said transfer belt is less than a volume resistivity of said second layer of said transfer belt;

wherein said bias member comprises a roller and wherein said second layer of said bias member comprises a metallic core of said roller, said metallic core having a diameter of 6 to 20 mm; and wherein said first layer of said bias member has a volume resistivity of $10^6$ Ωcm to $10^9$ Ωcm.

* * * * *